United States Patent [19]

Ford et al.

[11] Patent Number: 4,557,414

[45] Date of Patent: Dec. 10, 1985

[54] MEMBRANE-TYPE END CLOSURE MEMBER

[75] Inventors: James A. Ford, Winchester, Mass.; Gerald F. Staack, Chesterfield, Mo.; Phillip Waite, Cempston, England

[73] Assignee: Boise Cascade Corporation, Boise, Id.

[21] Appl. No.: 283,171

[22] Filed: Jul. 14, 1981 (Under 37 CFR 1.47)

[51] Int. Cl.[4] ..... B65D 3/12; B65D 5/64

[52] U.S. Cl. ..... 229/5.5; 220/359; 229/43

[58] Field of Search ..... 229/5.5, 43; 220/287, 220/309, 359

[56] References Cited

U.S. PATENT DOCUMENTS

| | | | |
|---|---|---|---|
| 1,950,173 | 3/1934 | Harris | 229/5.5 |
| 2,413,449 | 12/1946 | Hatch | 229/5.5 |
| 3,072,517 | 1/1963 | Gaylord | 229/5.5 |
| 3,434,651 | 3/1969 | Stec | 229/5.5 |
| 3,561,668 | 2/1971 | Bergstrom | 220/359 |
| 4,157,147 | 6/1979 | De Forest | 229/5.5 |
| 4,171,084 | 10/1979 | Smith | 229/5.5 |
| 4,190,187 | 2/1980 | Nelms | 229/5.5 |
| 4,196,841 | 4/1980 | Smith | 229/43 |
| 4,207,989 | 6/1980 | Ingemann | 220/359 |
| 4,211,338 | 7/1980 | Buhlitz | 220/359 |
| 4,280,653 | 7/1981 | Elias | 220/359 |
| 4,300,700 | 11/1981 | Chang | 229/43 |

FOREIGN PATENT DOCUMENTS

| | | | |
|---|---|---|---|
| 448570 | 5/1948 | Canada | 229/5.5 |
| 1200789 | 2/1958 | France | 229/43 |
| 2342215 | 9/1977 | France | 229/43 |
| 197809 | 9/1978 | Netherlands | 229/43 |
| 3714 | of 1915 | United Kingdom | 229/5.5 |

*Primary Examiner*—William Price
*Assistant Examiner*—Gary E. Elkins
*Attorney, Agent, or Firm*—Laubscher & Laubscher

[57] ABSTRACT

An improved membrane-type end closure member for composite containers or the like is disclosed, characterized in that the end closure member is deformed to define an annular deformation of generally V-shaped or flat bottom transverse cross-section, which deformation extends partially within the end of the container when the end closure member is bonded to the open upper end of the container body. The annular deformation, which is arranged between the annular flange portion that is bonded to the end extremity of the container and a central circular disk portion of the end closure member, serves to reinforce the relatively thin flexible membrane member and flexes or "domes" in response to variations in internal pressure of the container to maintain the container in a closed condition.

13 Claims, 4 Drawing Figures

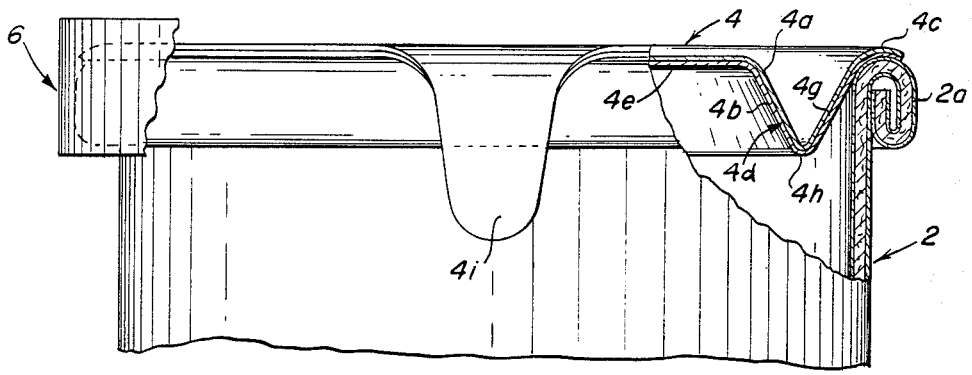
Fig. 1
Fig. 2
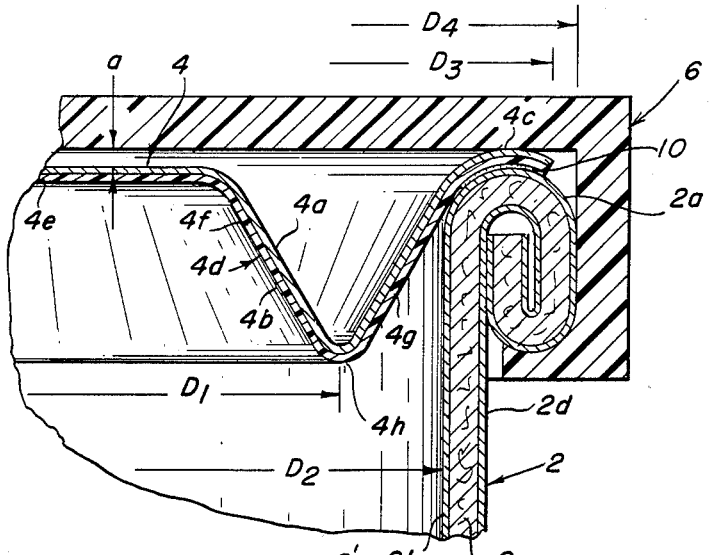
Fig. 3
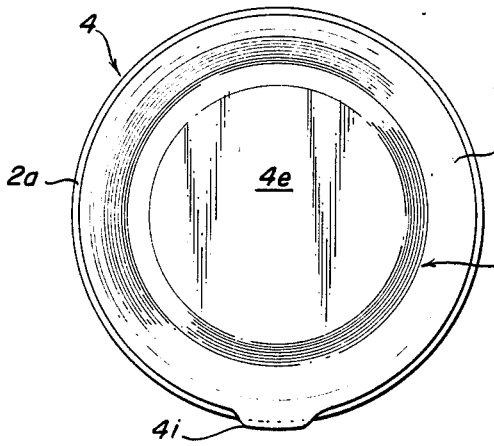
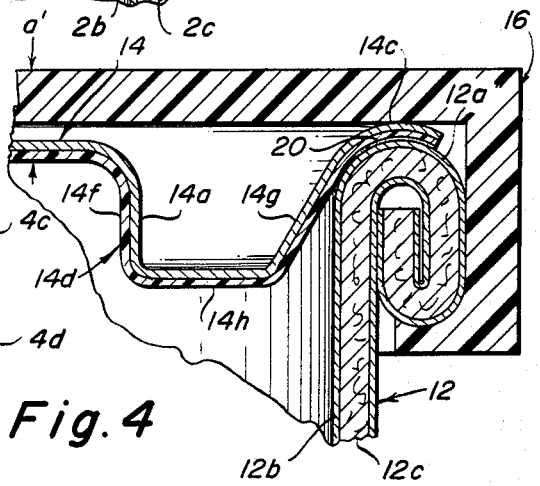
Fig. 4

MEMBRANE-TYPE END CLOSURE MEMBER

BRIEF DESCRIPTION OF THE PRIOR ART

Membrane-type end closure members for use with tubular containers are known in the art, as evidenced, for example, by the U.S. Patents to Johnson et al U.S. Pat. Nos. 3,892,351 and 3,988,185. These closures are made of a flat generally disk-shaped flexible impervious sheet material, which closures are generally heat sealed to one end of a tubular container.

One problem which is inherent to relatively large membrane-type containers is that of obtaining a tight hermetically-sealed bond between the membrane closure member and the container. More particularly, owing to the relatively large diameters of the end closure and container members, it is difficult to achieve proper alignment between the members and to rapidly and accurately position the members relative to each other during high-speed assembly with sufficient precision to assure the desired degree of seal. In the case of a heat seal bond, it is furthermore desirable to maintain the elements in precise alignment during the bonding operation, thereby to prevent undesirable crushing or creasing of the membrane during the sealing operation which would result in an improper seal. Since the closure member of the present invention is flexible, the closure can flex to some degree to conform to a slightly out-of-round container during alignment, thereby allowing a close fit with the container and a proper seal during the sealing step. Another problem with such relatively large membrane-type containers is that of compensating for variations in container internal pressure such as might occur from variations in altitude, ambient temperature or the like, while maintaining the desired integrity of the hermetic bond between the end closure member and the container. A further problem is that of obtaining, on the one hand, the desired hermetic bond between the end closure and container members while, on the other hand, providing a connection which permits peeling of the membrane member from the container without tearing of the membrane member. In certain cases the membrane end closure member has peripheral portions bonded to the inner and/or outer circumferential surfaces of the container, thereby resisting removal of the closure member from the container. Finally, owing to the relatively delicate nature of the thin flexible membrane end closure members, the removal of individual closure members from a stack and the transport and handling of these members relative to the associated containers presents a serious problem requiring complex equipment.

Accordingly, the present invention was developed to avoid the above and other drawbacks of the known types of membrane end closure members.

SUMMARY OF THE INVENTION

The primary object of the present invention is to provide an improved membrane-type end closure member of unexpectedly high peel and blow-off strength, including an annular aligning and reinforcing trough-shaped deformation which is adapted to extend axially partially within the container when the end closure member is mounted thereon. The deformation includes a downwardly converging outer side wall which terminates at its lower end in an annular bead the diameter of which is less than the internal diameter of the container, whereby the lower portion of the outer wall of the deformation is spaced from the container inner wall surface. Thus, the deformation assists in self-aligning of the components during the assembly thereof, and owing to the annular space defined between the outer deformation wall and the container, flexure of the central portion of the closure member upon variations in container internal pressure is permitted.

According to a more specific object of the invention, the annular trough-shaped deformation is formed between a generally flat horizontal central portion and an annular peripheral flange portion. Preferably, the flange portion is curved or bowed to conform to the end extremity of the container which, in the preferred embodiment, is the reversely outwardly curled end of a tubular composite container body. Preferably, the outer diameter of the end closure flange portion is less than the maximum outer diameter of the reversely curled end portion. A pull tab portion may be connected with the peripheral edge of the closure member for peeling the same from the container during opening. The membrane-type container is adapted for use with a conventional synthetic plastic protective overcap member, the horizontal central portion being recessed slightly inwardly relative to the annular flange portion to space the horizontal central-portion of the membrane closure member from the adjacent lower surface of the central portion of the overcap member, thereby to permit vertical displacement or doming of the central disk portion to accommodate variations in container internal pressure.

As a consequence of the present invention, the resistance of the membrane closure member to peeling and blow-off are significantly increased.

BRIEF DESCRIPTION OF THE DRAWING

Other objects and advantages of the invention will become apparent from a study of the following specification when viewed in the light of the accompanying drawing, in which:

FIG. 1 is a partly sectioned elevational view of the upper portion of a container including a first membrane-type end closure member of the present invention;

FIG. 2 is a detailed sectional view of the container of FIG. 1;

FIG. 3 is a plan view of the container of FIG. 1 with the synthetic plastic overcap removed; and FIG. 4 is a partly sectioned elevational view of another embodiment of the invention.

DETAILED DESCRIPTION

Referring now to the figures of the drawing, the container of the present invention includes a tubular composite container 2 having a reversely outwardly curled upper end portion 2*a* upon which is mounted a membrane-type end closure member 4. As is known in the art, a conventional protective synthetic plastic overcap member 6 is mounted upon the upper end of the container.

As shown in greater detail in FIG. 2, the tubular container body 2 is preferably of the composite container type including an impervious inner liner layer 2*b*, a fibrous body wall layer 2*c*, and an outer label layer 2*d*. Preferably, the liner layer 2*b* is formed of aluminum foil, and the outer label layer 2*d* is formed of aluminum foil, paper, a synthetic plastic material, or a suitable laminate thereof. The membrane-type end closure member 4 is preferably formed from a sheet of impervious material, such as a synthetic plastic material such as polyethylene or a polyester resin, a layer of metal foil, or a laminate, such as paper foil laminate, a paper synthetic plastic laminate, or the like. In the illustrated embodiment, the membrane-type end closure member includes an outer layer 4a formed of foil, and an inner layer 4b formed of a suitable bonding material, for example, a heat sealable material, such as polyethylene, ionomer, polypropylene, EVA, vinyl capolymers, hot melt and the like. The sheet material from which the end closure member is formed is relatively thin and is flexible, said end closure member including an annular outer peripheral flange portion 4c that is bonded to the uppermost extremity of the reversely curled end portion 2a of the tubular container body wall 2. In accordance with the present invention, the membrane-type end closure member contains an annular trough-shaped deformation 4d that extends axially partially within the upper end of the container body 2. The annular deformation portion 4d is arranged concentrically about a circular generally disk-shaped horizontal central portion 4e.

As shown in FIG. 2, the annular deformation 4d has a generally V-shaped transverse cross-section including downwardly converging inner and outer deformation side walls 4f and 4g, respectively. Thus, the lowermost annular bead 4h of the deformation has a diameter $D_1$ which is less than the diameter $D_2$ of the inner wall surface of the container 2. Generally, the difference between these diameters is about 0.015 inches, whereupon the lower portion of the outer deformation side wall 4g is spaced from the inner wall surface of the container. As shown in FIG. 2, the horizontal disk-shaped central portion 4e is recessed slightly downwardly relative to the annular flange portion 4c, thereby to provide the space "a" between the central disk portion 4e of the closure member and the lower surface of the central portion of the synthetic plastic protective overcap member 6.

Preferably, the outer diameter $D_3$ of the annular flange portion 4c of the membrane-type end closure member is slightly less than the maximum outer diameter $D_4$ of the reversely curled upper end portion of the container body 2, thereby to avoid the possibility of inadvertent breaking of the membrane seal when the overcap 6 is removed. A pull tab 4i is connected with the peripheral edge of the flange portion 4c for peeling the end closure member from the container body wall as will be described in greater detail below.

In accordance with the present invention, the annular trough-shaped deformation portion 4d of the membrane-type end closure member serves not only to structurally reinforce the relatively thin flexible closure member, but also to serve as an aligning means for expediting the assembly of the end closure member 4 to the container body 2. Furthermore, these annular deformations, owing to their trough-shaped transverse cross-sectional configurations facilitate high-speed handling and permit vertical stacking of a plurality of the closure members for ease in storage.

Preferably, the membrane-type end closure member is bonded to the reversely curled inner liner layer 2d by a conventional heat sealed connection, although, with the use of certain materials for the end closure member, it may be desired to bond the end closure member with the upper extremity of the container body 2 by a layer 10 of suitable bonding material such as an adhesive, a hot melt, or a layer of suitable heat sealable material.

In accordance with an important feature of the present invention, the end closure member 4, is designed for flexure to compensate for variations in the internal pressure of the container, such as might occur at differrent elevations and/or temperatures. More particularly, the central portion 4e of the end closure member may move vertically relative to the container 2 and the plastic overcap member 6. Depending on the spacing distance "a" provided between the lower surface of the overcap member and the central portion 4e of the end closure member; and in accordance with the resilient effect provided by the trough-shaped deformation 4d, a limited degree of vertical upward movement of the central portion of the closure member may be provided, thereby affording a "doming" effect when the pressure of the container contents increases.

To open the container, the synthetic plastic protective overcap member 6 is removed, and the pull tab portion 4i is pulled upwardly to progressively peel the peripheral flange portion 4c of the end closure member from the corresponding end extremity of the reversely curled end portion 2a of the container body 2. This peeling operation is improved as a consequence of the fact that the outer diameter $D_3$ of the flange portion 4c is less than the maximum outer diamter of the reversely curled portion 2a of the container body. In other words, the provision of an annular outer skirt portion on the end closure member is avoided. Furthermore, the peeling operation is facilitated owing to the fact that the lower end of the deformation outer wall 4g is spaced from the inner wall surface of the container. Preferably, the impervious liner layer 2b of the container body consists of a layer of aluminum foil or the like, the exposed surface of which is coated with a layer of a polyester resin, thereby to further improve the peelable characteristics of the end closure member without adversely affecting the hermetic bond between the components.

In actual laboratory comparison testing of the deformed end closure member of the present invention with a conventional planar disk membrane-type closure member (each including a layer of polyester resin as the heat sealable material effecting the bond between the end closure member and the container), the following results were obtained:

| | Flat Closure | Annularly Deformed Closure |
|---|---|---|
| | Opening Pull Test | |
| Average | 3.5 lbs. | 4.1 lbs. |
| Minimum | 2.8 lbs. | 3.1 lbs. |
| Maximum | 4.1 lbs. | 6.2 lbs. |
| | End Blowoff Test | |
| Average | 2.5 psi | 5.6 psi |
| Minimum | 2.0 psi | 4.0 psi |
| Maximum | 3.0 psi | 7.0 psi |

The optimal opening force was found to be 6 ± 2 lbs.

The criteria for minimum acceptable blowoff for a membrane type end closure member has been established as being 3.5 psig.

Thus, it is apparent that the end closure member of the present invention is positively designed for reliable heat sealing and exhibits good opening characteristics for a wide range of materials. The membrane-type end closure and composite container body members may be assembled and heat sealed at high production rates, and the resulting container possesses unexpected ability to withstand variations in internal container pressure (as might occur, for example, when the container is transported from a lower altitude to a higher altitude), and/or temperature.

Preferably, the flange portion 4c of the end closure member is curved or bowed to conform with the end extremity of the reversely curled container end portion, thereby resulting in a securely bonded seal. Furthermore, since the present invention provides resistance to peeling and blowoff, the necessity of an annular skirt portion for providing these resistances is eliminated, and accordingly the closure member may be more readily peeled from the container during the opening operation. Since the deformed end closure member is sufficiently rigid to permit handling and alignment thereof relative to the container without the use of the synthetic plastic overcap as a transporting means (as evidenced, for example, in the Westphal U.S. Pat. No. 3,961,566), there is no isolation of the end closure member from the heat sealing means by the overcap, as in the prior art. Doming of the central portion of the end closure member is permitted without endangering the integrity of the heat sealed bond whether or not a protective plastic overcap is provided. The membrane-type deformed closure member of the present invention is produced by the use of known die technology, the punching and deformation of the membrane material being effected in a single operation. The deformed end closure members may be stacked together, and the assembly machine uses vacuum pickup and air jet means for separating the individual closures and for placing the same in the pockets of the assembling apparatus, which pockets align the closure over the container body and release the closure to fall by gravity to the seated position upon the open upper end of the container body. The closure member is then heat sealed to the container by a conventional hot platten, spring means being provided for controlling the pressure applied to the assembly. Time is controlled by machine speed and cams or other standard timing devices. The pull tab may extend either downwardly, as shown, or may be folded back upon the upper surface of the end closure member. If desired, the protective overcap member may be applied at another station.

In the embodiment of FIG. 4, the end closure member 14 contains a trough-shaped annular deformation **14*d* having a flat bottom wall portion 14*h*, an inclined outer side wall portion 14*g*, and a generally vertical inner side wall portion 14*f*. As in the embodiment of FIG. 2, the annular deformation 14*d*** serves to structurally reinforce the end closure member, to serve as aligning means for expediting the fastening of the end closure member to the body wall, and as a diaphragm means for permitting limited expansion and contraction of the container volume.

While in accordance with the provisions of the Patent Statutes the preferred form and embodiments have been illustrated and described, it will be apparent that changes may be made without deviating from the inventive concepts set forth above.

What is claimed is:

1. A container including a membrane-type closure member, comprising:

(a) a tubular container member which is open at its upper end; and (b) end closure means closing said container upper end, said end closure means including a horizontal generally resilient peelable membrane-type closure member formed from a sheet of relatively thin flexible material, said closure member including (1) an annular flange portion bonded to the upper extremity of said container upper end;

(2) a horizontal circular central disk portion; and (3) an annular downwardly deformed trough portion connected between the peripheral edge of said disk portion and the inner peripheral edge of said annular portion, said trough portion having a downwardly and inwardly converging outer side wall, the diameter of the lowermost extremity of said outer side wall being less than the internal diameter of said container member, thereby to cause the lower portion of said outer side wall to be spaced inwardly from the inner wall surface of said container member, whereby said annular deformed trough portion assists in aligning the members during the assembly thereof, and also affords a limited degree of flexure permitting vertical displacement of said central disk portion relative to said annular flange portion when said membrane-type closure member is bonded to said container upper end, and further structurally reinforces said membrane-type closure member to improve the peeling operation of said peripheral flange portion from said container upper end and to preclude tearing of said membrane-type closure while peeling and the integrity of said closure member is maintained.

2. A container as defined in claim 1, wherein said end closure member is formed of an impervious material, said closure member being hermetically bonded to the upper end of said container.

3. A container as defined in claim 1, wherein said container member comprises a composite container body including a fibrous body wall layer and an inner liner layer, the upper end of said container body being reversely curled outwardly; and further wherein the cross-sectional configuration of said closure member flange portion is curved to conform with the outer surface of said reversely curled end of said container member.

4. A container as defined in claim 3, wherein said end closure member includes a layer of metal and means for bonding said closure member to said container member.

5. A container as defined in claim 3, wherein said end closure member includes a layer of synthetic plastic material bonded to said container member.

6. A container as defined in claim 3, wherein said end closure member includes a layer of fibrous material, and further including adhesive means bonding said end closure member to said container member.

7. A container as defined in claim 3, wherein said end closure member further includes a pull tab portion connected with the outer peripheral edge of said annular flange portion.

8. A container as defined in claim 3, wherein said central disk portion has a lower elevation than said annular flange portion, whereby when a protective overcap is mounted on the container upper end, a space is defined between the lower surface of the overcap and the central disk portion to permit upward vertical movement of the central disk portion to increase the effective volume of the container.

9. A contaner as defined in claim 1, wherein said trough portion has in transverse cross-section a generally V-shaped configuration.

10. A container as defined in claim 1, wherein said trough portion has in transverse cross-section a generally flat, horizontal bottom wall connected with the lower edge of said outer side wall, and a generally vertical inner side wall.

11. A membrane-type end closure member for use with composite containers and the like, said closure member being formed from a sheet of thin peelable membrane type lexible material and including (a) an annular flange portion adapted to be bonded to the open upper end of the container;

(b) a generally horizontal circular central disk portion; and (c) an annular deformed trough portion connected between said central disk and flange portions, said deformed trough portion including a downwardly converging outer wall, whereby said trough portion strengthens said membrane-type closure and provides axial displacement of said disk portion and structurally reinforces said membrane-type closure member and improves the peelability of flange from said container without tearing said membrane-type closure thereby maintaining the integrity thereof.

12. Apparatus as defined in claim 11, wherein said trough portion has in transverse cross-section a generally V-shaped configuration.

13. Apparatus as defined in claim 11, wherein said trough portion includes in transverse cross-section a generally horizontal flat bottom wall portion, and a generally vertical inner wall portion.

* * * * *